US009567042B1

(12) United States Patent
Trattner, Jr.

(10) Patent No.: US 9,567,042 B1
(45) Date of Patent: Feb. 14, 2017

(54) PORTABLE BOAT MOORING SYSTEM AND ASSOCIATED METHOD

(76) Inventor: Stephen W. Trattner, Jr., Ocean City, MD (US)

( * ) Notice: Subject to any disclaimer, the term of this patent is extended or adjusted under 35 U.S.C. 154(b) by 0 days.

(21) Appl. No.: 13/167,688

(22) Filed: Jun. 23, 2011

Related U.S. Application Data

(60) Provisional application No. 61/357,596, filed on Jun. 23, 2010.

(51) Int. Cl.
*B63B 22/02* (2006.01)

(52) U.S. Cl.
CPC ..... *B63B 22/02* (2013.01)

(58) Field of Classification Search
CPC ..... B63B 22/02; B63B 22/025
USPC ..... 114/230.1, 230.2, 230.25, 230.26,114/230.27, 230.28, 230.29; 441/1, 3, 6, 80, 81, 441/129, 131, 132, 133, 134, 136
See application file for complete search history.

(56) References Cited

U.S. PATENT DOCUMENTS 3,486,342 A * 12/1969 Aks ..... 405/212
3,597,779 A * 8/1971 Morgan ..... 441/133
4,098,214 A * 7/1978 Ogura ..... 114/267
4,221,252 A 9/1980 Bruce
4,357,891 A * 11/1982 Sluys ..... 114/230.27
4,386,919 A * 6/1983 Kadono ..... 441/133
4,488,502 A * 12/1984 Girard ..... 114/230.26
4,726,313 A 2/1988 Neal
4,813,466 A * 3/1989 Forsyth et al. ..... 152/179
5,460,418 A 10/1995 Falls
5,467,727 A 11/1995 Godvin et al.
5,937,781 A 8/1999 Isella et al.
6,062,158 A 5/2000 Blanchard
7,699,676 B2 * 4/2010 Nicholson ..... 441/6
7,771,245 B2 * 8/2010 Routeau et al. ..... 441/133

* cited by examiner

*Primary Examiner* — Daniel V Venne

(57) ABSTRACT

A flotation device capable of being used with a portable mooring system preferably includes a first bumper ring including a first male end and a first female end diametrically spaced therefrom, a second bumper ring including a second male end and a second female end diametrically spaced therefrom, an anchor bracket affixed to an outer surface of at least one of the first and second bumper rings, a cleat removably attached to the anchor bracket, and a quick release handle removably penetrated through one of the first and second male ends as well as a corresponding one of the first and second female ends. In this manner, the first and second bumper rings define a circle when interfitted to each other. Such first and second bumper rings are preferably formed from buoyant material.

17 Claims, 5 Drawing Sheets

PORTABLE BOAT MOORING SYSTEM AND ASSOCIATED METHOD

CROSS REFERENCE TO RELATED APPLICATIONS

This application claims the benefit of U.S. Provisional Application No. 61/357,596, filed Jun. 23, 2010, the entire disclosures of which are incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Technical Field

This invention relates to mooring systems and, more particularly, to a portable boat mooring system for providing users with an easy and convenient means of securing their boats to a pier or the like without having to adjust the length of the tying member during high or low tides.

Prior Art

The recreational use of power boats, sail boats and smaller yachts has become a popular activity worldwide. These smaller sized recreational boats may be stored at home and carried to the water on boat trailers and down into the water. Larger boats may be kept at marinas, which offer a mooring protected from the weather and a variety of support services, such as fuel, equipment and so forth. These boats have to be tied to a pier for example when the boat is stored in the water. The equipment used usually comprises fenders, dock lines and other equipment to protect and secure the boat while docked. The currently used main functional parts may include an anchor, a rope to tie the anchor to the float, and a mooring float for tying the boat to.

A problem faced by many boaters is that the rope may have insufficient length resulting in a boat being "hung" from the rope during low tide. A rope that is too long may cause the boat to bump or be whipped against the securing pole or anchor and may cause damage to the boat or other boats during inclement weather. As such, boat owners may have to frequently check or call a friend to "check their lines" to be sure there is enough length or shortness depending upon the tides. Known devices designed to overcome this problem are permanently mounted, expensive, and appears complicated to install and maintain.

Accordingly, a need remains for a system in order to overcome the above-noted shortcomings. The present invention satisfies such a need by providing a portable boat mooring system that is convenient and easy to use, lightweight yet durable in design, versatile in its applications, and designed for securing boats to a pier or the like without having to adjust the length of the tying member during high or low tides.

BRIEF SUMMARY OF THE INVENTION

In view of the foregoing background, it is therefore an object of the present invention to provide a flotation device capable of being used with a portable mooring system. These and other objects, features, and advantages of the invention are provided by a flotation device including a first bumper ring including a first male end and a first female end diametrically spaced therefrom, a second bumper ring including a second male end and a second female end diametrically spaced therefrom, an anchor bracket affixed to an outer surface of at least one of the first and second bumper rings, a cleat removably attached to the anchor bracket, and a quick release handle removably penetrated through one of the first and second male ends as well as a corresponding one of the first and second female ends. In this manner, the first and second bumper rings define a circle when interfitted to each other. Such first and second bumper rings are preferably formed from buoyant material.

In a non-limiting exemplary embodiment, the first and second bumper rings are pivotally connected to each other at the quick release handle.

In a non-limiting exemplary embodiment, each of the first and second male ends may be provided with a male aperture. Each of the first and second female ends may be provided with a plurality of female apertures. Notably, each of the male apertures may be vertically aligned with the female apertures when the first and second male ends are interfitted within the first and second female ends, respectively.

In a non-limiting exemplary embodiment, each of the first and second bumper rings preferably remains coplanar while selectively displaced along an arcuate path defined about a fulcrum axis aligned along the quick release handle. In this manner, the fulcrum axis may be registered orthogonal to a mutual plane of the first and second bumper rings.

In a non-limiting exemplary embodiment, a lanyard may be attached to the quick release handle and one of the first and second bumper rings.

In a non-limiting exemplary embodiment, the quick release handle preferably passes through the first and second bumper rings when the first and second bumper rings are pivotally engaged to each other.

In a non-limiting exemplary embodiment, the first and second male ends may be slidably interfitted within the first and second female ends while being displaced along the arcuate paths, respectively.

In a non-limiting exemplary embodiment, the first and second bumper rings may be freely detached from each other when the quick release handle is removed therefrom, respectively.

The present disclosure may further include a method of utilizing a flotation device with a portable mooring system. Such a method preferably includes the chronological steps of: providing a first bumper ring including a first male end and a first female end diametrically spaced therefrom; and providing a second bumper ring including a second male end and a second female end diametrically spaced therefrom. Each of the first and second bumper rings are preferably formed from buoyant material.

The method further include the chronological steps of: providing and affixing an anchor bracket to an outer surface of at least one of the first and second bumper rings; providing and removably attaching a cleat to the anchor bracket; providing and removably penetrating a quick release handle through one of the first and second male ends as well as a corresponding one of the first and second female ends; and defining a circle by interfitting the first and second bumper rings to each other respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
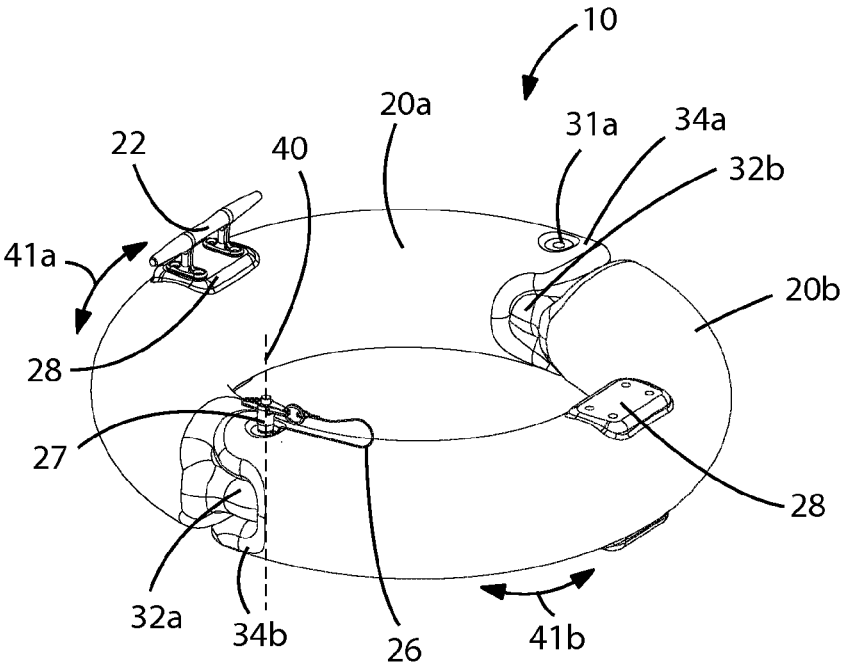
FIG. 1 is a perspective view showing a floatation dock device, in accordance with the present invention.
Figure 2:
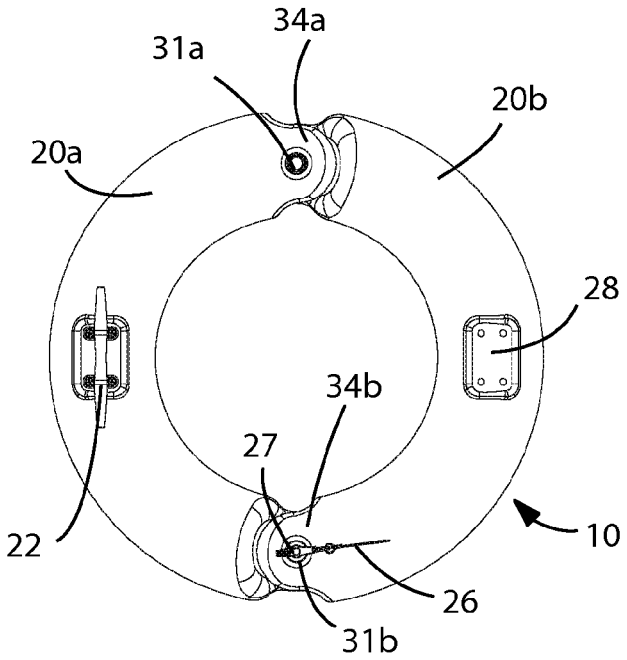
FIG. 2 is a top plan view of the floatation dock device shown in FIG. 1.
Figure 3:
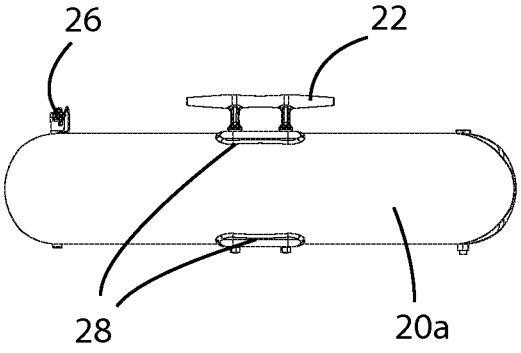
FIG. 3 is a front elevational view of the floatation dock device shown in FIG. 1.
Figure 4:
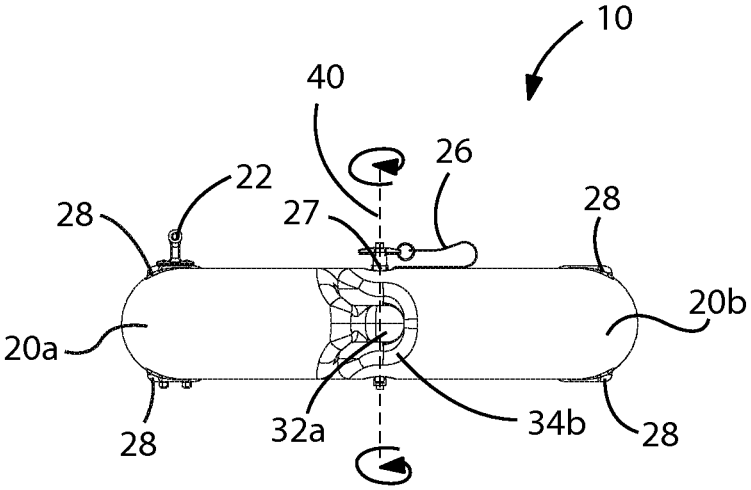
FIG. 4 is a side elevational view of the floatation dock device shown in FIG. 1.
Figure 5:
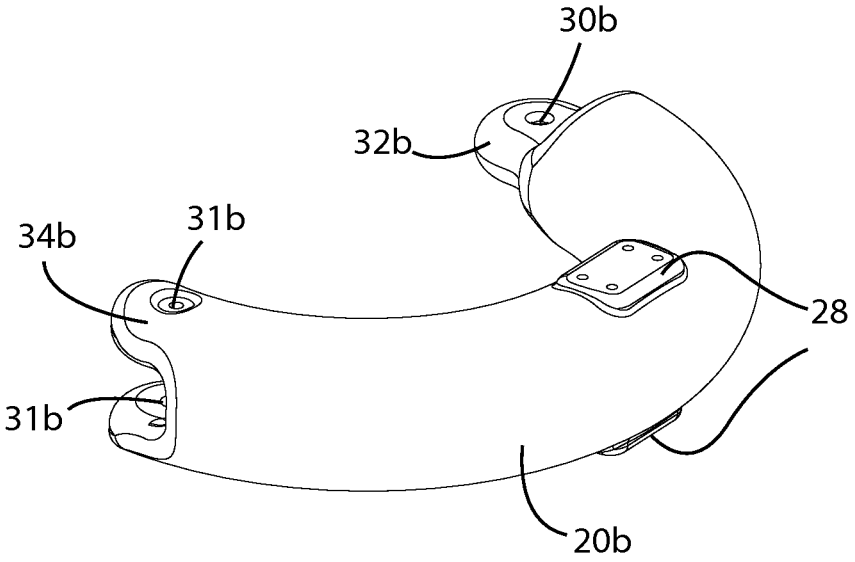
FIG. 5 is a perspective view showing a first bumper ring of the floatation dock device shown in FIG. 1.
Figure 6:
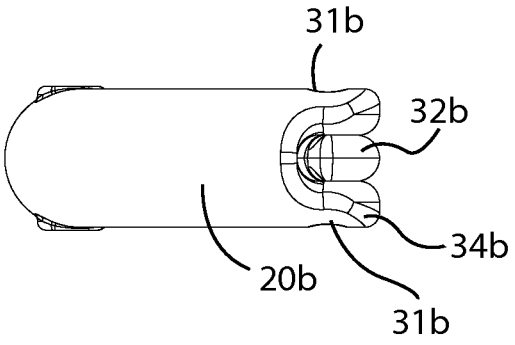
FIG. 6 is a front elevational view of the first bumper ring of the floatation dock device shown in FIG. 5.
Figure 7:
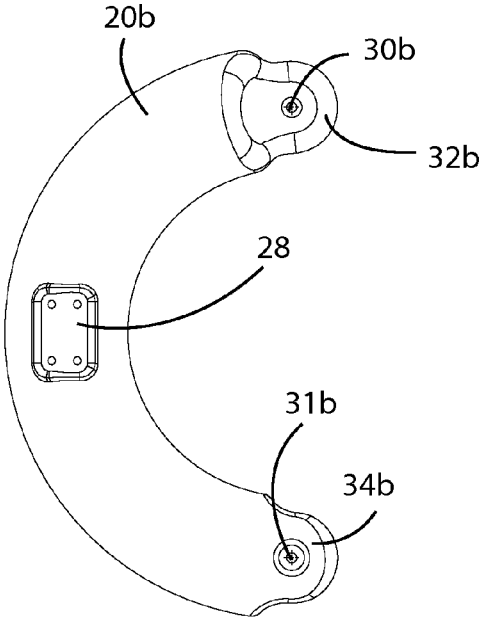
FIG. 7 is a top plan view showing a second bumper ring of the floatation dock device shown in FIG. 1.
Figure 8:
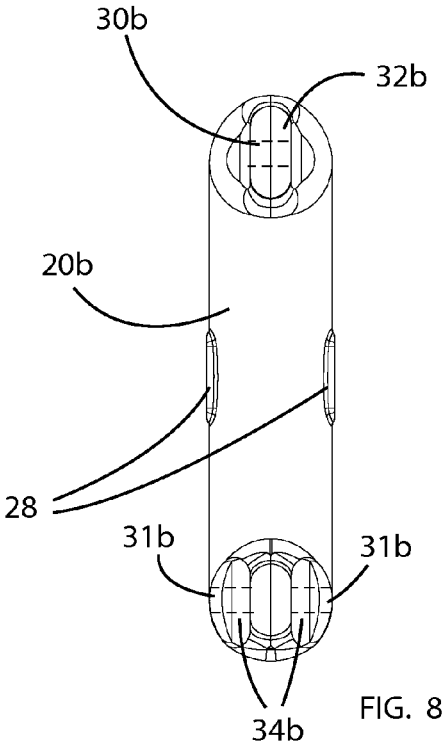
FIG. 8 is a side elevational view of the second bumper ring of the floatation dock device shown in FIG. 7.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The device of this invention is referred to generally in FIGS. 1-9 and is intended to provide a floating device used with a portable boat mooring system. It should be understood that the present invention may be used to secure boats and many different types of watercraft to a pier or the like without having to adjust the length of the tying member during high or low tides. It is noted that the term portable boat mooring system is used generally to describe a system that is able to maintain a watercraft moored to a support structure. The "first bumper ring" is the same as the claimed "first bumper arcuate member." The claimed "first bumper arcuate member" is identified at reference numeral "20*a*." The "second bumper ring" is the same as the claimed "second bumper arcuate member." The claimed "second bumper arcuate member" is identified at reference numeral "20*b*." The claimed "plurality of anchor brackets" are identified at reference numeral "28." The claimed "one anchor bracket" is also identified at reference numeral "28" and is shown directly engaged with cleat 22, in FIG. 9.

Referring to FIGS. 1-9 in general, a flotation device 10 capable of being used with a portable mooring system preferably includes a first bumper ring 20*a* including a first male end 32*a* and a first female end 34*a* diametrically spaced therefrom, a second bumper ring 20*b* including a second male end 32*b* and a second female end 34*b* diametrically spaced therefrom, an anchor bracket 28 affixed to an outer surface of at least one of the first and second bumper rings 20*a*, 20*b*, a cleat 22 removably attached to the anchor bracket 28, and a quick release handle 27 has a linear rod portion 80 removably penetrated through one of the first and second male ends 32*a*, 32*b* as well as a corresponding one of the first and second female ends 34*a*, 34*b*. In this manner, the first and second bumper rings 20*a*, 20*b* define a circle when interfitted to each other. Such first and second bumper rings 20*a*, 20*b* are preferably formed from buoyant material. Such a structural configuration provides the unexpected and unpredictable advantage of securing a watercraft to a support structure without having to adjust the length of a tying member (rope-not shown) during high or low tides.

In a non-limiting exemplary embodiment, the first and second bumper rings 20*a*, 20*b* are pivotally connected to each other at the quick release handle 27.

In a non-limiting exemplary embodiment, each of the first and second male ends 32*a*, 32*b* may be provided with a male aperture 30*a*, 30*b*. Each of the first and second female ends 34*a*, 34*b* may be provided with a plurality of female apertures 31*a*, 31*b*. Notably, each of the male aperture s 30*a*, 30*b* may be vertically aligned with the female apertures 31*a*, 31*b* when the first and second male ends 32*a*, 32*b* are interfitted within the first and second female ends 34*a*, 34*b*, respectively. Such a structural configuration provides the unexpected and unpredictable advantage of ensuring the first and second bumper rings 20*a*, 20*b* freely pivot along an uninterrupted path as needed.

In a non-limiting exemplary embodiment, each of the first and second bumper rings 20*a*, 20*b* preferably remains coplanar while selectively displaced along an arcuate path 41*a*, 41*b* defined about a fulcrum axis 40 aligned along the quick release handle 27. In this manner, the fulcrum axis 40 may be registered orthogonal to a mutual plane of the first and second bumper rings 20*a*, 20*b*. Such a structural configuration provides the unexpected and unpredictable advantage of ensuring the first and bumper rings 20*a*, 20*b* can be easily attached and detached to each other, as needed.

In a non-limiting exemplary embodiment, a lanyard 26 may be attached to the quick release handle 27 and one of the first and second bumper rings 20*a*, 20*b*.

In a non-limiting exemplary embodiment, the linear rod portion 80 of quick release handle 27 preferably passes through the first and second bumper rings 20*a*, 20*b* when the first and second bumper rings 20*a*, 20*b* are pivotally engaged to each other.

In a non-limiting exemplary embodiment, the first and second male end 32*a*, 32*b* may be slidably interfitted within the first and second female end 34*a*, 34*b* while being displaced along the arcuate paths, respectively. Such a structural configuration provides the unexpected and unpredictable advantage of permitting the user to conveniently pivot one bumper ring relative to the other.

In a non-limiting exemplary embodiment, the first and second bumper rings 20*a*, 20*b* may be freely detached from each other when the linear rod portion 80 of quick release handle 27 is removed therefrom, respectively.

The present disclosure may further include a method of utilizing a flotation device 10 with a portable mooring system. Such a method preferably includes the chronological steps of: providing a first bumper ring 20*a* including a first male end 32*a* and a first female end 34*a* diametrically spaced therefrom; and providing a second bumper ring 20*b* including a second male end 32*b* and a second female end 34*b* diametrically spaced therefrom. Each of the first and second bumper rings 20*a*, 20*b* are preferably formed from buoyant material.

The method further includes the chronological steps of: providing and affixing an anchor bracket 28 to an outer surface of at least one of the first and second bumper rings 20*a*, 20*b*; providing and removably attaching a cleat 22 to the anchor bracket 28; providing and removably penetrating a linear rod portion 80 of a quick release handle 27 through one of the first and second male ends 32*a*, 32*b* as well as a corresponding one of the first and second female ends 34*a*, 34*b*; and defining a circle by interfitting the first and second bumper rings 20*a*, 20*b* to each other respectively.

Figure 9:
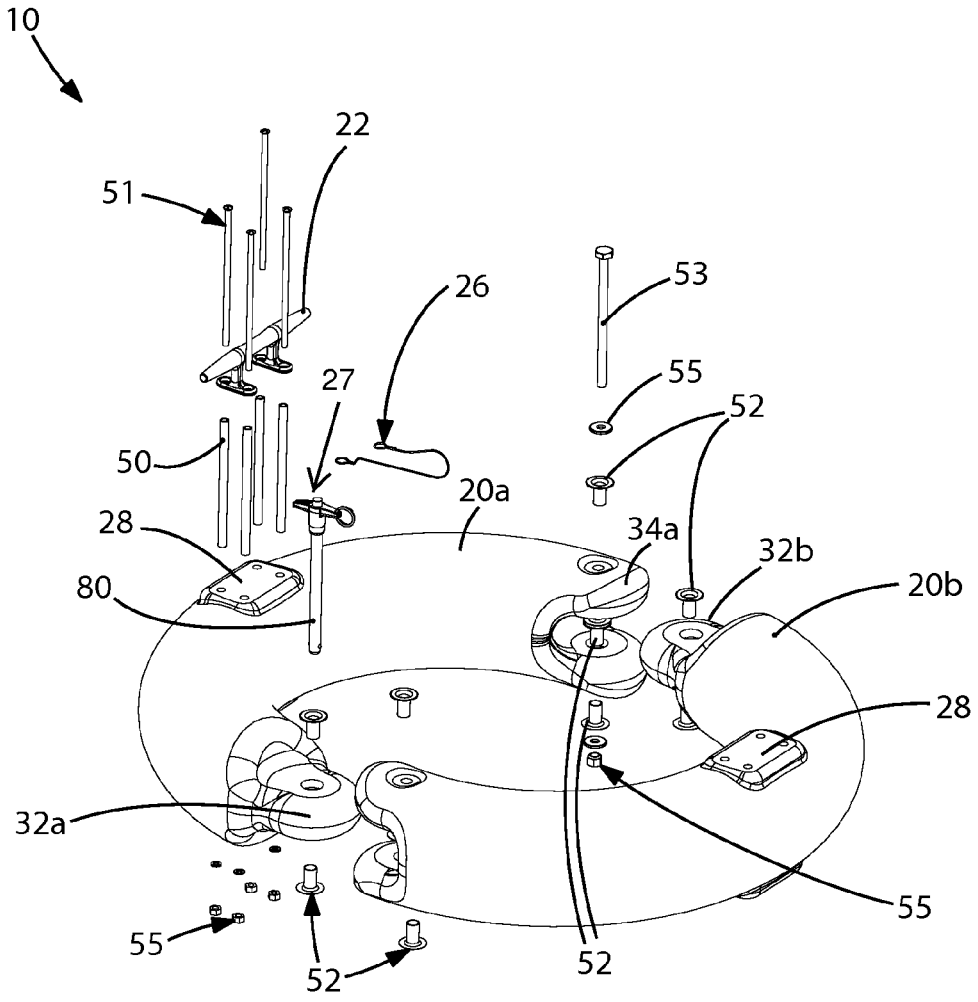
FIG. 9 is an exploded view showing the interrelationship between the major components of the floating device.

In a non-limiting exemplary embodiment, as perhaps best shown in FIG. 9, a plurality of fasteners such as screws, bolts, nuts washers, and spacers are illustrated to connect the bumper rings 20*a*, 20*b*, cleat 22, anchor brackets 28, and lanyard 26 in a desired configuration. For example, elongated rectilinear spacers 50 may be linearly fitted through the anchor brackets 28 and bumper rings 20*a*, 20*b*. Corresponding bolts 51 may be linearly positioned through such spacers 50 and locked in place via washers and nuts 55, for example. Flanged spacers 52 having flanged top edges may be employed for receiving and guiding bolts 53 through the male and female apertures 32, 34 of the bumper rings 20*a*, 20*b*, respectively. Such bolts 53 are locked in place via washers and nuts 55. In particular, opposed sides of the apertures 32, 34 may be fitted with the shorter spacers 52 so that the bumper rings 20*a*, 20*b* remain freely pivotal, as needed. In this way, the bumper rings may be detachably connected to each other to form a circular-shaped flotation device 10.

In use, the portable boat mooring system would be simple and straightforward to use. First, the user may assemble the flotation device 10 as described hereinabove. The flotation device 10 may be freely positioned about a support structure, such as a docking pole located on a pier or the like. A lanyard 26 may further be removably tethered to cleat 22 and secure handle 27 so it is not lost if dropped. In this way, the flotation device 10 may be detachably wrapped around the docking pole and therefore slidingly rises and falls with the water level during tidal changes. Such an arrangement provides the unexpected and unpredictable advantage of enabling the boat to be secured without having to adjust the length of the rope for low and high water levels.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A flotation device capable of being used with a portable mooring arcuate member system, said flotation device comprising:

a first bumper arcuate member including a first male end and a first female end diametrically spaced therefrom;

a second bumper arcuate member including a second male end and a second female end diametrically spaced therefrom;

a plurality of anchor brackets affixed to an outer surface of said first and second bumper arcuate members, respectively;

a cleat removably attached to one of said anchor brackets; and a release handle having a linear rod portion removably penetrated through one of said first and second male ends as well as a corresponding one of said first and second female ends;

wherein each of said first and second bumper arcuate members are formed from buoyant material.

2. The floatation device of claim 1, wherein said first and second bumper arcuate members are pivotally connected to each other at said release handle.

3. The floatation device of claim 1, wherein each of said first and second male ends is provided with a male aperture, wherein each of said first and second female ends is provided with a plurality of female apertures, wherein each of said male apertures is vertically aligned with said female apertures when said first and second male ends are interfitted within said first and second female ends respectively.

4. The floatation device of claim 1, wherein each of said first and second bumper arcuate members remains coplanar while selectively displaced along an arcuate path defined about a fulcrum axis aligned along said release handle, said fulcrum axis being registered orthogonal to a mutual plane of said first and second bumper arcuate members.

5. The floatation device of claim 1, further comprising: a lanyard attached to said release handle and one of said first and second bumper arcuate members.

6. The floatation device of claim 1, wherein said linear rod portion of said release handle passes through said first and second bumper arcuate members when said first and second bumper arcuate members are pivotally engaged to each other.

7. The floatation device of claim 4, wherein said first and second male ends are slidably interfitted within said first and second female ends while being displaced along said arcuate paths respectively.

8. The floatation device of claim 1, wherein said first and second bumper arcuate members are freely detached from each other when said linear rod portion is removed therefrom respectively.

9. A flotation device capable of being used with a portable mooring arcuate member system, said flotation device comprising:

a first bumper arcuate member including a first male end and a first female end diametrically spaced therefrom;

a second bumper arcuate member including a second male end and a second female end diametrically spaced therefrom;

a plurality of anchor brackets affixed to an outer surface of said first and second bumper arcuate members, respectively;

a cleat removably attached to one of said anchor brackets; and a release handle having a linear rod portion removably penetrated through one of said first and second male ends as well as a corresponding one of said first and second female ends;

wherein said first and second bumper arcuate members define a circle when interfitted to each other;

wherein each of said first and second bumper arcuate members are formed from buoyant material;

wherein said one anchor bracket is directly engaged to said cleat;

wherein said linear rod portion is spaced from said one anchor bracket and said cleat;

wherein said one anchor bracket is spaced from each of said first male end, said first female end, said second male end and said second female end;

wherein said cleat is spaced from each of said first male end, said first female end, said second male end and said second female end.

10. The floatation device of claim 1, wherein said first and second bumper arcuate members are pivotally connected to each other at said release handle.

11. The floatation device of claim 1, wherein each of said first and second male ends is provided with a male aperture, wherein each of said first and second female ends is provided with a plurality of female apertures, wherein each of said male apertures is vertically aligned with said female apertures when said first and second male ends are interfitted within said first and second female ends respectively.

12. The floatation device of claim 1, wherein each of said first and second bumper arcuate members remains coplanar while selectively displaced along an arcuate path defined about a fulcrum axis aligned along said release handle, said fulcrum axis being registered orthogonal to a mutual plane of said first and second bumper arcuate members.

13. The floatation device of claim 1, further comprising: a lanyard attached to said release handle and one of said first and second bumper arcuate members.

14. The floatation device of claim 1, wherein said linear rod portion of said release handle passes through said first and second bumper arcuate members when said first and second bumper arcuate members are pivotally engaged to each other.

15. The floatation device of claim 12, wherein said first and second male ends are slidably interfitted within said first and second female ends while being displaced along said arcuate paths respectively.

16. The floatation device of claim 1, wherein said first and second bumper arcuate members are freely detached from each other when said linear rod portion is removed therefrom respectively.

17. A method of utilizing a flotation device with a portable mooring arcuate member system, said method comprising the chronological order of steps:

providing a first bumper arcuate member including a first male end and a first female end diametrically spaced therefrom;

providing a second bumper arcuate member including a second male end and a second female end diametrically spaced therefrom, wherein each of said first and second bumper arcuate members are formed from buoyant material;

providing and affixing a plurality of anchor brackets to an outer surface of said first and second bumper arcuate members, respectively;

providing and removably attaching a cleat to one of said anchor brackets;

providing and removably penetrating a linear rod portion of a release handle through one of said first and second male ends as well as a corresponding one of said first and second female ends; and defining a circle by interfitting said first and second bumper arcuate members to each other respectively;

wherein said one anchor bracket is directly engaged to said cleat;

wherein said linear rod portion is spaced from said one anchor bracket and said cleat;

wherein said one anchor bracket is spaced from each of said first male end, said first female end, said second male end and said second female end;

wherein said cleat is spaced from each of said first male end, said first female end, said second male end and said second female end.

* * * * *